US009562507B2

(12) United States Patent
Sago et al.

(10) Patent No.: US 9,562,507 B2
(45) Date of Patent: Feb. 7, 2017

(54) ENGINE START SWITCH

(71) Applicant: ALPS ELECTRIC CO., LTD., Tokyo (JP)

(72) Inventors: Tetsuya Sago, Miyagi-ken (JP); Kazuma Sato, Miyagi-ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 119 days.

(21) Appl. No.: 14/681,787

(22) Filed: Apr. 8, 2015

(65) Prior Publication Data

US 2015/0337788 A1 Nov. 26, 2015

(30) Foreign Application Priority Data

May 23, 2014 (JP) ..... 2014-107558

(51) Int. Cl.

| | |
|---|---|
| ***H01H 13/14*** | (2006.01) |
| ***H01H 13/02*** | (2006.01) |
| ***H01H 9/02*** | (2006.01) |
| ***F02N 11/08*** | (2006.01) |
| ***H01H 13/52*** | (2006.01) |

(52) U.S. Cl.

CPC ..... *F02N 11/0807* (2013.01); *H01H 13/52* (2013.01); *F02N 11/0814* (2013.01); *F02N 2011/0874* (2013.01)

(58) Field of Classification Search

CPC ..... F02N 11/0807; F02N 11/0814; F02N 2011/0874; F02N 11/0803; F02N 2200/10; H01H 13/52; H01H 13/023; H01H 2300/032; H01H 27/00; H01H 2231/026; H01H 9/0271; B60R 25/04

USPC ..... 340/5.62, 426.17, 426.3, 426.35, 426.36, 340/5.31; 180/279, 283; 307/112, 10.3, 307/10.4, 10.5

See application file for complete search history.

(56) References Cited

U.S. PATENT DOCUMENTS 5,118,909 A * 6/1992 Husting ..... H01H 3/24 200/302.2
5,532,522 A * 7/1996 Dietz ..... B60R 25/04 180/287

(Continued)

FOREIGN PATENT DOCUMENTS

JP 2013100818 A * 5/2013
JP 5502975 B2 * 5/2014
KR 1321551 * 10/2013

*Primary Examiner* — Hai Huynh
*Assistant Examiner* — Raza Najmuddin
(74) *Attorney, Agent, or Firm* — Beyer Law Group LLP

(57) ABSTRACT

An engine start switch includes, a case member which includes a tubular support portion having an opening portion formed on the front side, a slide member which is slidably supported in a front-rear direction in the inner portion of the tubular support portion, an operation member which is connected to the front side of the slide member, and is movably supported in the front-rear direction in front of the tubular support portion, an annular coil antenna configured to radiate a radio wave signal forward, a wiring substrate which is electrically connected to the coil antenna, and detection means for detecting a rearward movement of the operation member. The coil antenna is attached to the front side of the wiring substrate to configure an antenna substrate assembly, and the antenna substrate assembly is attached to the case member to be positioned between the slide member and the operation member.

4 Claims, 9 Drawing Sheets

(56) References Cited

U.S. PATENT DOCUMENTS 5,729,057 A * 3/1998 Frenzel ..... B60Q 1/323 180/287
7,132,615 B1 * 11/2006 Greer ..... H01H 1/5805 200/313
7,187,266 B2 * 3/2007 Hasegawa ..... B60R 25/04 307/10.2
7,290,416 B2 * 11/2007 Ohtaki ..... B60R 25/04 200/43.08
8,542,092 B2 * 9/2013 Lumley ..... B60R 25/10 340/10.1
2004/0145449 A1 * 7/2004 Yamamoto ..... B60R 25/04 340/5.72
2004/0207516 A1 * 10/2004 Ohtaki ..... B60R 25/04 340/438
2006/0055517 A1 * 3/2006 Ghabra ..... B60R 25/2063 340/426.11
2007/0241862 A1 * 10/2007 Dimig ..... B60R 25/04 340/5.62
2007/0252681 A1 * 11/2007 Costello ..... B60Q 3/0243 340/426.3
2009/0115250 A1 * 5/2009 Kim ..... H01H 27/08 307/10.5
2010/0207725 A1 * 8/2010 Hattori ..... G07C 9/00944 340/5.72
2011/0121925 A1 * 5/2011 Emmerling ..... B60R 25/04 335/2
2012/0075063 A1 * 3/2012 Sakamoto ..... B60R 25/04 340/5.62
2012/0199461 A1 * 8/2012 Shim ..... B60R 25/00 200/52 R
2014/0224631 A1 * 8/2014 Hanaoka ..... H01Q 23/00 200/341
2014/0291131 A1 * 10/2014 Sago ..... H01H 13/06 200/302.2
2015/0170850 A1 * 6/2015 Kirita ..... H01H 13/52 200/314
2015/0179366 A1 * 6/2015 Kirita ..... F02N 11/0807 200/314
2015/0233335 A1 * 8/2015 Lim ..... F02N 11/0803 200/52 R
2016/0155591 A1 * 6/2016 Miura ..... H01H 50/443 335/202
2016/0180613 A1 * 6/2016 Kishimoto ..... G07C 9/00944 340/5.61

* cited by examiner

ENGINE START SWITCH

CLAIM OF PRIORITY

This application claims benefit of Japanese Patent Application No. 2014-107558 filed on May 23, 2014, which is hereby incorporated by reference.

BACKGROUND OF THE INVENTION

1. Field of the Invention

The present invention relates to an engine start switch, and particularly, to an engine start switch in which the number of components is decreased and assembly is simple.

2. Description of the Related Art

A system referred to as a keyless entry system is widely spread, which can perform locking or unlocking of a door in a vehicle or a vehicle operation such as starting and stopping of an engine using wireless communication between an on-board communication device mounted on the vehicle and a portable machine (hereinafter, abbreviated as an electronic key) referred to as an electronic key without using a mechanical type key.

In the keyless entry system, a radio signal (hereinafter, abbreviated as a request signal) referred to as a request signal is sent from the on-board communication device to the electronic key, and a radio signal (hereinafter, abbreviated as a response signal) referred to as a response signal corresponding to the request signal is sent from the electronic key to the on-board communication device.

In addition, authentication is performed based on the response signal which is received by the on-board communication device, and when the authentication is established, the above-described vehicle operation is permitted. For example, it is possible to start or stop the engine by operating an engine start switch which is disposed in the cabin of a vehicle.

In recent years, when a battery of the electronic key side is consumed and the response signal is not sent from the electronic key, as the engine start switch used in the keyless entry system, an engine start switch is in practical use, which includes a coil antenna capable of outputting drive radio waves generating an electromotive force for driving the circuit of the electronic key side when the electronic key is held in the vicinity of the engine start switch.

A technology with respect to the engine start switch is disclosed in U.S. Pat. No. 8,810,363. FIG. 9 is an exploded perspective view showing a configuration of a start and stop switch device 101 (engine start switch) according to U.S. Pat. No. 8,810,363.

The start and stop switch device 101 performs collation (authentication) of an ID code (ID information) using wireless communication between a vehicle and a portable machine (electronic key), and is used as an ignition switch of a smart ignition system (keyless entry system) which starts an engine by operating an ignition switch when the collation is established.

As shown in FIG. 9, the start and stop switch device 101 includes a switch unit 158, a push button 159, a coil antenna 160, an antenna case member 166, a circuit substrate 173, a lid member 176, and a garnish 184 (cover member).

The antenna case member 166 includes a switch accommodating portion 169, a cylindrical portion 167 and a flange portion 168 which are formed on the front side of the switch accommodating portion 169, and a substrate accommodating portion 170 which is formed on the rear side of the switch accommodating portion 169. The switch unit 158 is accommodated in the switch accommodating portion 169, the coil antenna 160 is accommodated inside the cylindrical portion 167, and the circuit substrate 173 is accommodated in the substrate accommodating portion 170.

In addition, the push button 159 is disposed to cover the outer circumferential portion of the cylindrical portion 167, and the garnish 184 (cover member) is disposed to cover the outer circumferential portion of the push button 159. Moreover, the lid member 176 is disposed to cover the rear side of the circuit substrate 173.

The push button 159 receives a rearward pressing operation. The switch unit 158 switches a switching mode (a connection state or the like of the circuit) corresponding to the pressing operation with respect to the push button 159.

The coil antenna 160 includes a cylindrical bobbin 164, and a coil 120 which is formed by winding a wire around the outer circumferential portion of the bobbin 164. Both end portions of the coil 120 are connected to the circuit substrate 173 via a terminal 165 which is a wiring member. An electronic component is mounted on the circuit substrate 173, and generates electric signals becoming transponder drive radio waves (drive radio waves). In addition, the coil antenna 160 outputs (radiates the electric signals forward) the electric signals generated by the circuit substrate 173 as the transponder drive radio waves. The circuit substrate 173 is connected to an external circuit (not shown) via a wire (not shown) which extends to the outside through an opening portion 177 formed on the lid member 176.

The start and stop switch device 101 is configured as above. In addition, when the battery of the portable machine side is consumed and the radio signals is not sent from the portable machine, if the portable machine is held in the vicinity of the start and stop switch device 101, the coil antenna 160 outputs the transponder drive radio waves toward the portable machine. In addition, on the portable machine side, it is possible to generate an electromotive force for driving a transponder (response circuit) using the transponder drive radio waves.

SUMMARY OF THE INVENTION

In the start and stop switch device 101 disclosed in U.S. Pat. No. 8,810,363, the circuit substrate 173 is disposed behind the switch unit 158, and the coil antenna 160 is disposed in front of the switch unit 158. In this way, since the circuit substrates 173 and the coil antenna 160 are disposed at positions separated from each other, after the coil antenna 160 and the circuit substrate 173 are individually processed and are disposed at predetermined positions, it is necessary to connect the coil antenna and the circuit substrate via the wring member such as the terminal 165. Accordingly, when the start and stop switch device 101 is assembled, the number of components is increased, and the assembly is complicated.

The present invention provides an engine start switch in which the number of components is decreased and the assembly is simple.

According to an aspect of the present invention, there is provided an engine start switch, including: a case member which includes a tubular support portion having an opening portion formed on the front side of the tubular support portion; a slide member which is slidably supported in a front-rear direction in the inner portion of the tubular support portion; an operation member which is connected to the front side of the slide member, and is movably supported in the front-rear direction in front of the tubular support portion; an annular coil antenna configured to radiate a radio wave signal forward; a wiring substrate which is electrically connected to the coil antenna; and detection means for detecting a rearward movement of the operation member, in which the coil antenna is attached to the front side of the wiring substrate to configure an antenna substrate assembly, and the antenna substrate assembly is attached to the case member so as to be positioned between the slide member and the operation member.

In the engine start switch, since the coil antenna is attached to the front side of the wiring substrate to configure the antenna substrate assembly, it is possible to handle the coil antenna and the wiring substrate as an integral member when the engine start switch is assembled. In addition, since it is possible to dispose the coil antenna in the vicinity of the wiring substrate, a wiring member for connecting the coil antenna and the wiring substrate is not needed. As a result, it is possible to decrease the number of components when the engine start switch is assembled. In addition, since the number of components is decreased, it is possible to simply assemble the engine start switch.

The engine start switch may further include a connection portion configured to connect the slide member and the operation member, and the connection portion may connect the slide member and the operation member so that relative movements of the slide member and the operation member with respect to the antenna substrate assembly in the front-rear direction are not disturbed.

In the engine start switch, the connection portion connects the slide member and the operation member so that relative movements of the slide member and the operation member with respect to the antenna substrate assembly in the front-rear direction are not disturbed. Accordingly, even when the antenna substrate assembly is disposed between the slide member and the operation member, it is possible to smoothly move the slide member and the operation member.

In the engine start switch, the operation member may be disposed at a predetermined interval on the front side of the slide member, the connection portion may extend to surround a rearward space of the operation member rearward from an outer circumferential portion of the operation member, and the antenna substrate assembly may be disposed in a space which is surrounded by the slide member, the operation member, and the connection member.

In the engine start switch, the antenna substrate assembly is disposed in the space surrounded by the slide member, the operation member, and the connection portion. Accordingly, even when the connection portion moves in the front-rear direction along with the operation member or the slide member, it is possible to prevent the connection portion from being abutted to the antenna substrate assembly. As a result, it is possible to more smoothly move the slide member and the operation member.

The engine start switch may further include an attaching portion configured to attach the antenna substrate assembly to the case member, and the attaching portion may attach the antenna substrate assembly to the case member so that relative movements of the slide member and the operation member with respect to the antenna substrate assembly in the front-rear direction are not disturbed.

In the engine start switch, the attaching portion attaches the antenna substrate assembly to the tubular support portion so that the relative movements of the slide member and the operation member with respect to the antenna substrate assembly in the front-rear direction are not disturbed. Accordingly, even when the antenna substrate assembly is disposed between the slide member and the operation member, it is possible to smoothly move the slide member and the operation member.

In the engine start switch, the coil antenna may include an annular bobbin portion for winding a wire formed in a coil, the attaching portion may extend rearward from an outer circumferential portion of the bobbin portion, and a notch portion or an opening portion may be formed at a position corresponding to the attaching portion of the slide member.

In this engine start switch, the attaching portion extends rearward from an outer circumferential portion of the bobbin portion, and a notch portion or an opening portion is formed at a position corresponding to the attaching portion of the slide member. Accordingly, even when the slide member and the operation member move in the front-rear direction, it is possible to prevent the attaching portion from being abutted to the slide member. As a result, it is possible to more smoothly move the slide member and the operation member.

In the engine start switch, the detection means may be a switch element configured to include a fixed contact which is formed on the front surface side of the wiring substrate, and a movable contact which is disposed on the front side of the fixed contact and comes into contact with and is separated from the fixed contact in conjunction with a pressing operation of the operation member.

In this engine start switch, the detection means for detecting the rearward movement of the operation member is the switch element configured to include the fixed contact which is formed on the front surface side of the wiring substrate, and the movable contact which is disposed on the front side of the fixed contact. The structure of the switch element having the above-described configuration is simple. Accordingly, it is possible to further decrease the number of components of the engine start switch. Moreover, since the switch element having the above-described configuration is easily thinned, it is possible to shorten the length of the engine start switch in the front-rear direction.

In the engine start switch, a light-emitting element may be mounted on the front surface side of the wiring substrate.

In the engine start switch, since the light-emitting element is mounted on the front surface side of the wiring substrate, it is possible to illuminate the operation member. In addition, since the operation member is disposed on the front side of the wiring substrate, it is possible to shorten the distance between the operation member and the light-emitting element, and it is possible to increase illumination efficiency.

In the engine start switch, a connector, which includes a terminal extending rearward, may be disposed at a position close to the outer circumferential portion of the rear surface side of the wiring substrate, and a concave portion, in which the terminal is accommodated, may be formed at the position of the case member corresponding to the connector.

In the engine start switch, since the concave portion, in which the terminal is accommodated, is formed at the position of the case member corresponding to the connector, the terminal of the connector and an external wire can be connected to each other inside the concave portion. Accordingly, compared to a case where the terminal of the connector and the external wire are connected to each other on the rear side of the case member, it is possible to shorten the length of the engine start switch in the front-rear direction. In addition, since the connector is disposed at the position close to the outer circumferential portion of the rear surface side of the wiring substrate, it is possible to open the outer circumferential portion side of the concave portion, and a connection work between the terminal of the connector and the external wire is easily performed.

According to the present invention, it is possible to provide the engine start switch in which the number of components is decreased and the assembly is simple.

DESCRIPTION OF THE PREFERRED EMBODIMENTS

Hereinafter, an embodiment of the present invention will be described with reference to the drawings. In addition, in each drawing, the embodiment is described while an X1 direction is set to a left direction, an X2 direction is set to a right direction, a Y1 direction is set to a front side, a Y2 direction is set to a rear side, a Z1 direction is set to an upper side, and a Z2 direction is set to a lower side.

Figure 1:
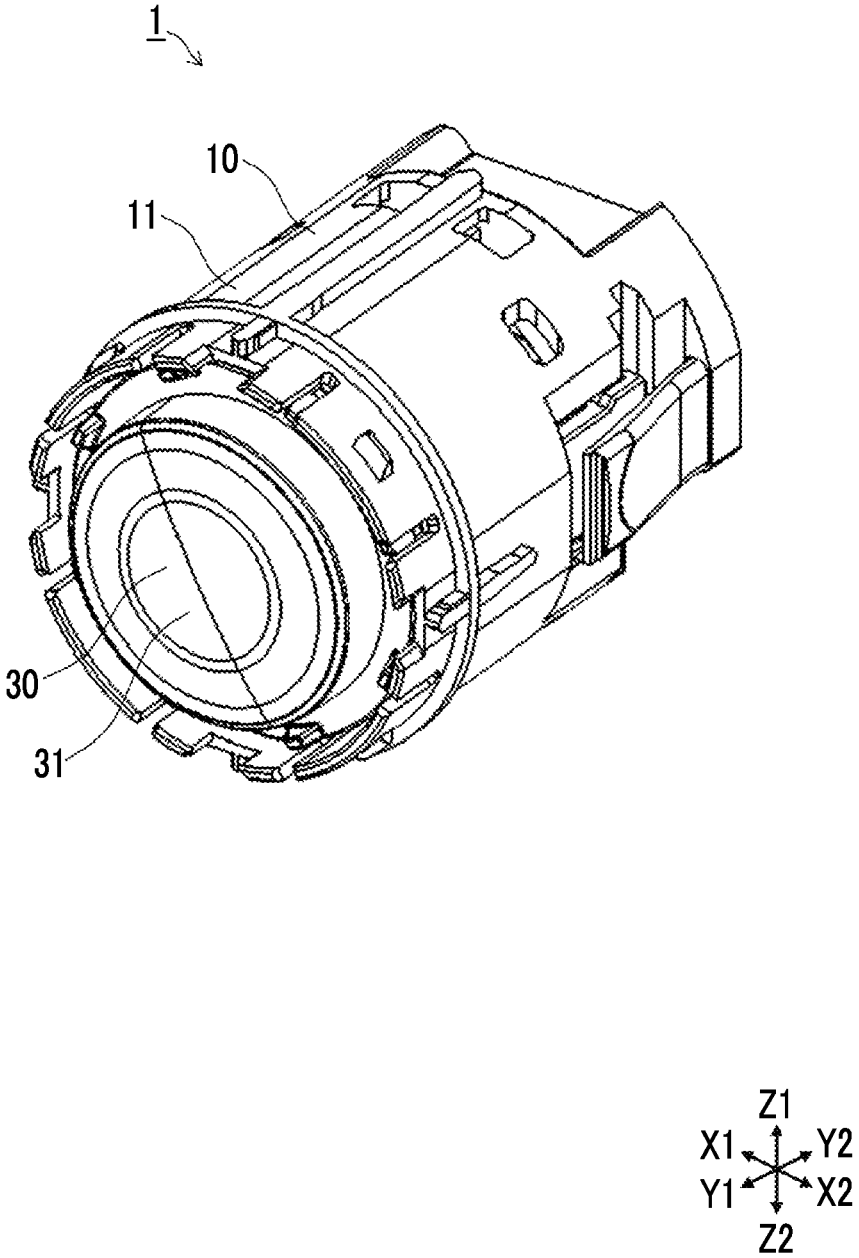
FIG. 1 is a perspective view of an engine start switch1 according to an embodiment of the present invention.
Figure 2:
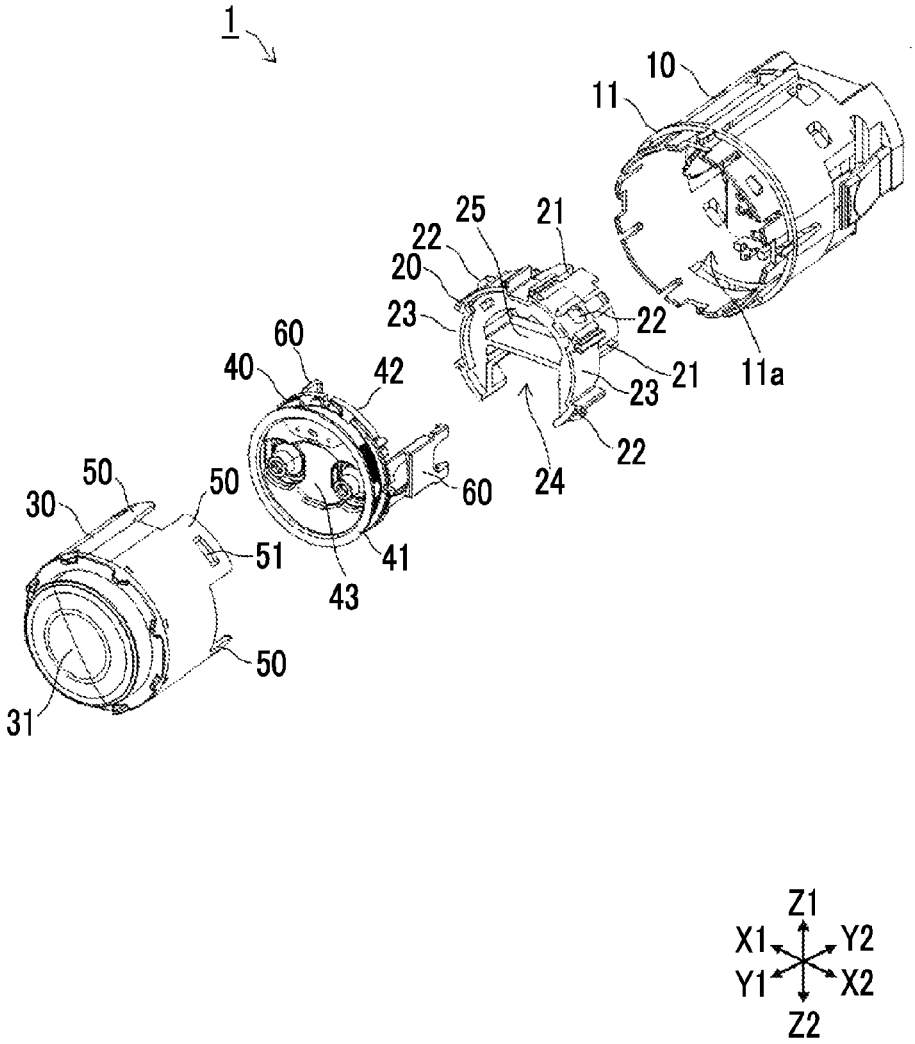
FIG. 2 is an exploded perspective view of the engine start switch 1 shown in FIG. 1.
Figure 3:
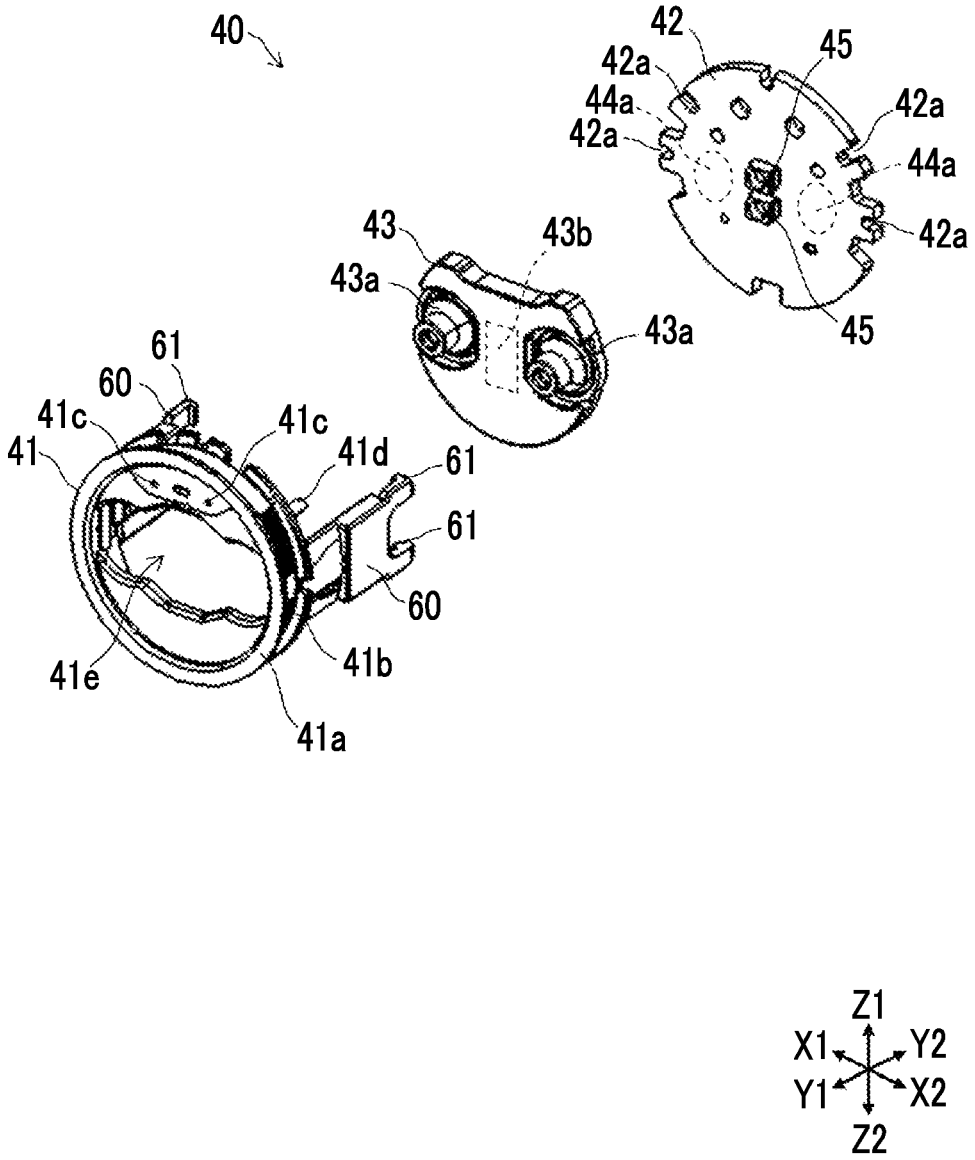
FIG. 3 is an exploded perspective view of an antenna substrate assembly 40 shown in FIG. 2.
Figure 4A:
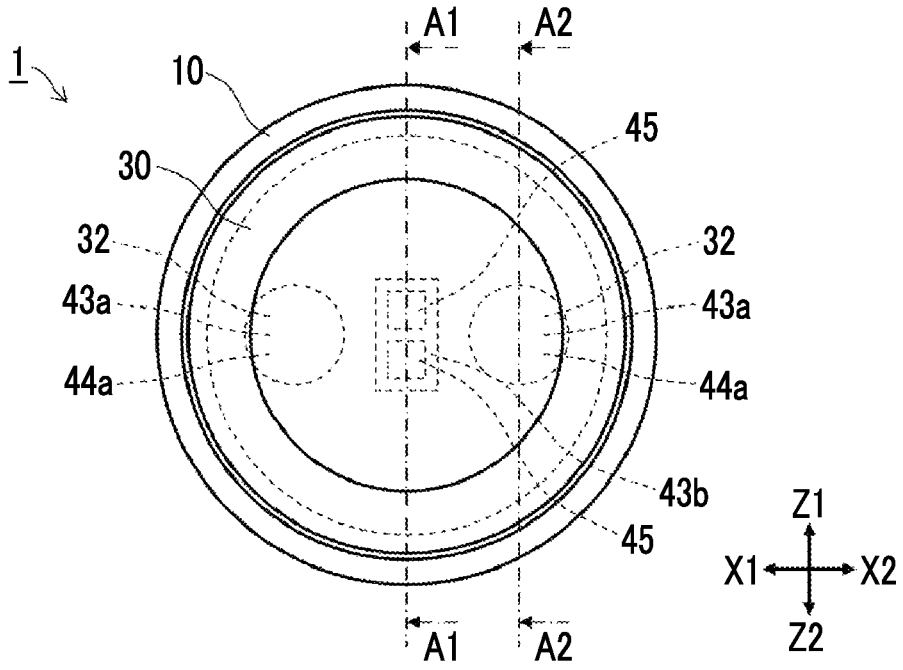
FIGS. 4A and 4B are schematic views when the engine start switch 1 shown in FIG. 1 is viewed from a front side and a rear side.
Figure 4B:
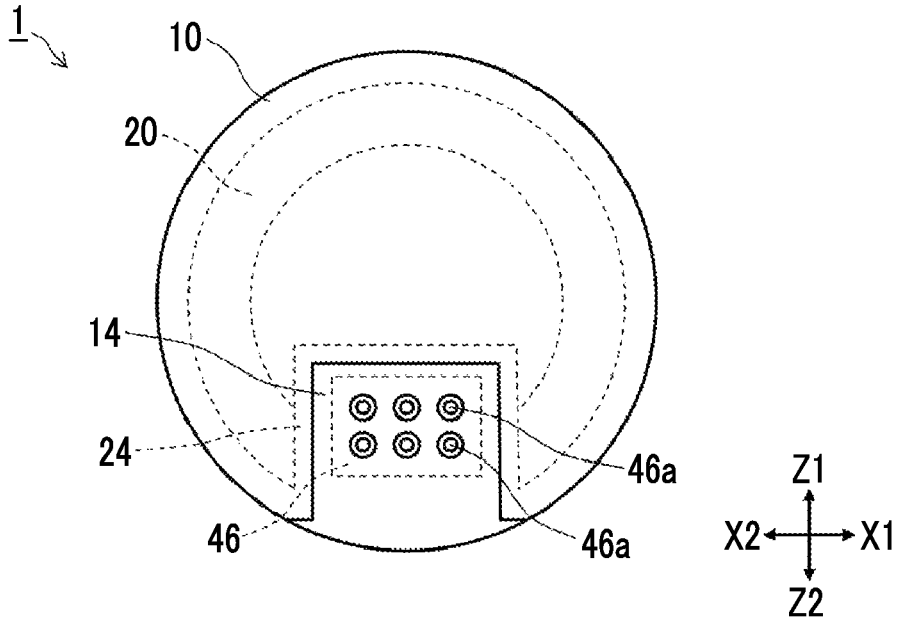
Figure 5A:
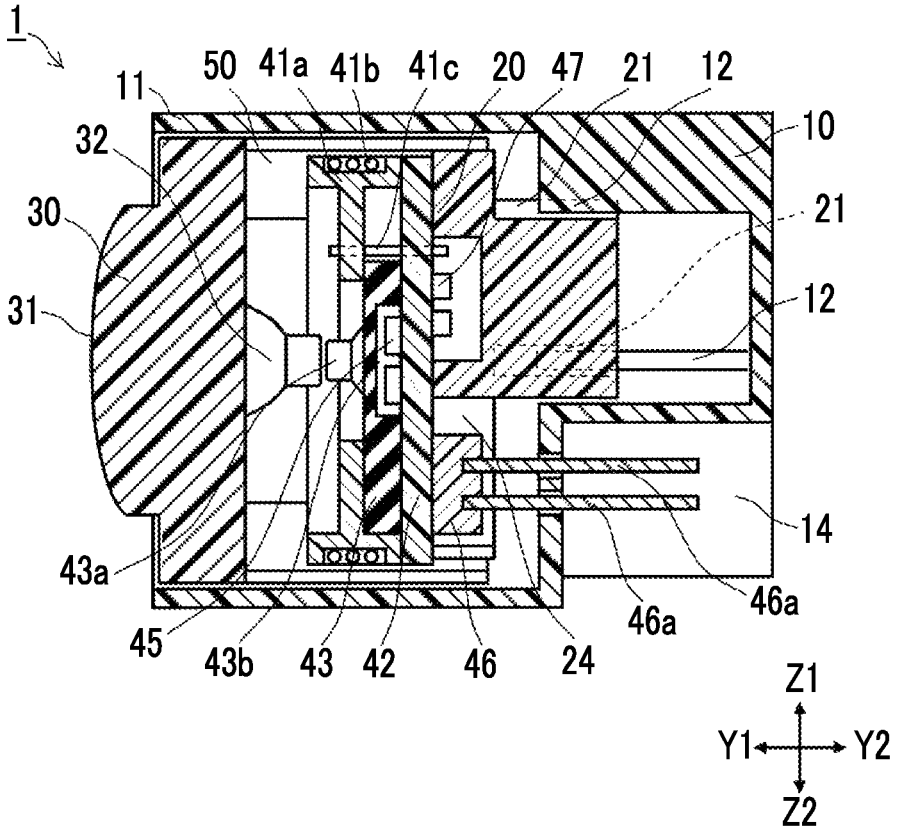
FIGS. 5A and 5B are schematic views showing a side cross-sectional structure of the engine start switch 1 shown in FIG. 1.
Figure 5B:
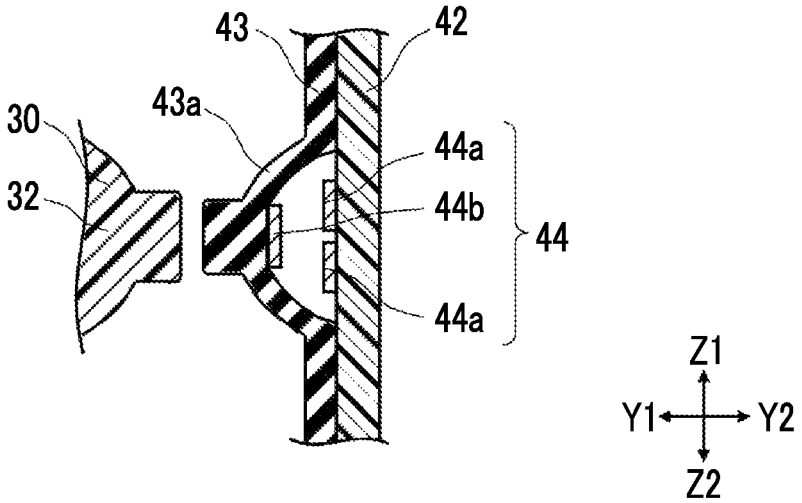

First, a configuration of an engine start switch1 according to the embodiment of the present invention will be described with reference to FIGS. 1 to 5B. FIG. 1 is a perspective view of the engine start switch 1 according to the embodiment of the present invention. FIG. 2 is an exploded perspective view of the engine start switch 1 shown in FIG. 1. FIG. 3 is an exploded perspective view of an antenna substrate assembly 40 shown in FIG. 2. FIGS. 4A and 4B are schematic views when the engine start switch 1 shown in FIG. 1 is viewed from a front side and a rear side. FIG. 4A is the schematic view when the engine start switch 1 is viewed from the front side, and FIG. 4B is the schematic view when the engine start switch 1 is viewed from the rear side. FIGS. 5A and 5B are schematic views showing a side cross-sectional structure of the engine start switch 1 shown in FIG. 1. FIG. 5A is the schematic view showing the side cross-sectional structure of the engine start switch 1 taken along VA-VA cross-section of FIG. 4A, and FIG. 5B is the schematic view showing a side cross-sectional structure of a switch element 44 taken along VB-VB cross-section of FIG. 4A.

The engine start switch 1 according to the embodiment of the present invention is used in a system referred to as a keyless entry system. The keyless entry system is a system which can perform locking or unlocking of a door in a vehicle or a vehicle operation such as starting and stopping of an engine using wireless communication between an on-board communication device mounted on a vehicle and a portable machine (hereinafter, abbreviated as an electronic key) referred to as an electronic key without using a mechanical type key.

In the keyless entry system, a radio signal (hereinafter, abbreviated as a request signal) referred to as a request signal is sent from the on-board communication device to the electronic key, and a radio signal (hereinafter, abbreviated as a response signal) referred to as a response signal corresponding to the request signal is sent from the electronic key to the on-board communication device.

In addition, authentication is performed based on the response signal which is received by the on-board communication device, and when the authentication is established, the above-described vehicle operation is permitted. For example, it is possible to start or stop the engine by operating the engine start switch 1 which is disposed in the cabin of a vehicle.

As shown in FIGS. 1 and 2, the engine start switch 1 includes a case member 10, a slide member 20, an operation member 30, an antenna substrate assembly 40, a connection portion 50 for connecting the slide member 20 and the operation member 30, and an attaching portion 60 for attaching the antenna substrate assembly 40 to the case member 10.

The case member 10 is a member which is formed of a synthetic resin. As shown in FIG. 2, the case member 10 has a cylindrical outline which extends in a front-rear direction. A tubular support portion 11, in which a cylindrical opening portion 11*a* is formed on the front side of the tubular support portion, is formed on the front portion of the case member 10. As shown in FIGS. 4A and 4B, a terminal accommodating portion 14 is formed at a portion close to the lower side of the rear portion of the case member 10. The terminal accommodating portion 14 is a concave portion which is formed so as to be recessed upward from the outer circumferential portion on the lower side of the case member 10.

The slide member 20 is a member which is formed of a synthetic resin. As shown in FIG. 2, the front portion of the slide member 20 has an outer diameter which is slightly smaller than an inner diameter of the opening portion 11*a* of the case member 10, and has a shape in which a portion of a cylindrical member extending forward is notched. The rear portion of the slide member 20 has an outer diameter which is smaller than that of the front portion of the slide member 20, and has a shape in which a lower side of a cylindrical member extending the rear side is notched.

As shown in FIG. 2, sliding grooves 21 extending in the front-rear direction are formed at predetermined positions of the outer circumferential portion on the rear portion side of the slide member 20. Connecting convex portions 22 are formed as predetermined positions of the outer circumferential portion on the front portion side of the slide member 20. Attaching notch portions 23, which are recessed from the outer circumferential portion side of the slide member 20 toward the center, are formed in the vicinities of the left end portion and the right end portion of the front portion of the slide member 20. A connection notch portion 24 which is recessed upward from the outer circumferential portion side of the slide member 20 is formed at a position close to the lower side of the front portion of the slide member 20. A circuit accommodating portion 25 which is recessed from the front surface to the rear surface is formed at a position close to the upper side of the slide member.

The operation member 30 is a member which is formed of a synthetic resin. As shown in FIG. 2, the operation member 30 has a cylindrical outline extending in the front-rear direction. An operation surface 31 which receives an operation from a user is formed on the front surface of the operation member 30. As shown in FIGS. 4A to 5B, pressing portions 32 protruding rearward are formed at the position close to the left side and at the position close to the right side of the rear portion of the operation member 30. In addition, the inner portion of the operation member 30 is formed using a translucent material, and thus, the operation surface 31 can be illuminated when light is radiated from the rear side.

As shown in FIG. 3, the antenna substrate assembly 40 is configured to include a coil antenna 41, a wiring substrate 42, and a rubber member 43. The coil antenna 41 includes an annular bobbin portion 41*a* which is formed of a synthetic resin, a coil portion 41*b* which is formed by winding a wire around the outer circumference of the bobbin portion 41*a*, and a circuit connection terminal 41*c* to which both ends of the wire of the coil portion 41*b* are connected. Fitting convex portions 41*d* protruding rearward are formed at predetermined positions of the outer circumferential portion of the bobbin portion 41*a*. A pressing opening portion 41*e* extending right and left is formed on the front surface of the bobbin portion 41*a*.

As shown in FIG. 3, the wiring substrate 42 is a substrate which includes front and rear plate surfaces on a disk. Fitting notch portions 42*a* are formed at positions of the wring substrate 42 corresponding to the fitting convex portions 41*d*. In addition, as shown in FIGS. 4A to 5B, fixed contacts 44*a* are formed at positions on the front surface side of the wiring substrate 42 corresponding to the pressing portions 32 of the operation member 30. Moreover, two light-emitting elements 45 such as a light-emitting diode are mounted on the center portion on the front surface side of the wiring substrate 42. As shown in FIGS. 5*a* and 5*b*, an electronic component 47 is mounted at a position close to the upper side of the rear surface of the wiring substrate 42, and thus, an electronic circuit is configured. In addition, a connector 46 including external connection terminals 46*a* extending rearward is attached at a position close to the lower side of the rear surface of the wiring substrate 42.

The rubber member 43 is a sheet-like member which is formed of a material having elasticity. As shown in FIGS. 5A and 5B, the rubber member 43 is attached to the front surface side of the wiring substrate 42. As shown in FIGS. 3 to 5B, embossing portions 43*a* which are embossed so that the front surface side protrudes and the rear surface side is recessed are formed at positions corresponding to the pressing portions 32 of the operation member 30. When each of the embossing portions 43*a* is pressed from the front side, the embossing portion is 43*a* elastically deformed. As shown in FIGS. 5A and 5B, a movable contact 44*b* which comes into contact with and is separated from the fixed contact 44*a* is formed on the rear surface side of the embossing portion 43*a*.

In addition, the fixed contact 44*a* of the wiring substrate 42 and the movable contact 44*b* of the rubber member 43 configure the switch element 44. Since an electrode structure or an operation principle of the switch element is well-known, detailed descriptions thereof are omitted. However, for example, the fixed contact 44*a* is configured of two electrodes which are disposed so as to be adjacent to the front surface of the wiring substrate 42, and it is possible to switch the connection state between the two electrodes of the fixed contact 44*a* by allowing the movable contact 44*b* formed on the embossing portion 43*a* of the rubber 43 simultaneously to come into contact with and to be separated from the two electrodes of the fixed contact 44*a*.

As shown in FIGS. 4A to 5B, an element accommodating portion 43*b* which is recessed forward is formed at the position corresponding to the light-emitting element 45 on the rear surface side of the rubber member 43. In addition, when the rubber member 43 is attached to the wiring substrate 42, the light-emitting element 45 mounted on the wiring substrate 42 is accommodated in the element accommodating portion 43*b* of the rubber element 43. The vicinity of the element accommodating portion 43*b* of the rubber member 43 is formed using a translucent material, and light emitted from the light-emitting element 45 transmits forward via the vicinity of the element accommodating portion.

As shown in FIG. 2, the connection portion 50 is provided to extend rearward from a predetermined position of the outer circumferential portion of the operation member 30. Connecting hole portions 51 to which the connecting convex portions 22 are fitted are formed at positions on the rear end portion side of the connection portion 50 corresponding to the connecting convex portions 22.

In addition, generally, each of the connection portions 50 is integrally formed with the operation member 30. However, since the connection portion 50 can be attached to the operation member 30 after the connection portion is prepared so as to be separated from the operation member 30, the operation member 30 and the connection portion 50 will be described as separate members.

As shown in FIGS. 2 and 3, the attaching portion 60 extends rearward from the outer circumferential portion of the bobbin portion 41*a* of the coil antenna 41. A rear end portion 61 of the attaching portion 60 has a hook structure, and engages with an attaching hole (not shown) of the case member 10. When the member having the hook structure engages with the attaching hole formed on the case member, since an attachment method or the structure of the attaching hole is well-known, the detailed descriptions thereof are omitted.

In addition, generally, the attaching portion 60 is integrally formed with the bobbin portion 41*a* of the coil antenna 41. However, since the attaching portion 60 can be attached to the coil antenna 41 after the attaching portion is prepared so as to be separated from the coil antenna 41, the coil antenna 41 and the attaching portion 60 will be described as separate members.

Next, a method for assembling the antenna substrate assembly 40 will be described. As described above, the antenna substrate assembly 40 includes the coil antenna 41, the wiring substrate 42, and the rubber member 43. In addition, after the rubber member 43 is attached to the front surface side of the wiring substrate 42, the coil antenna 41 is attached to the front side of the wiring substrate 42. The front side and the rear side of rubber member 43 are interposed between the coil antenna 41 and the wiring substrate 42, the fitting convex portions 41*d* of the coil antenna 41 are fitted to the fitting notch portions 42*a* of the wiring substrate 42, and thus, the wiring substrate 42 is fixed to the coil antenna 41.

In this way, the antenna substrate assembly 40 is assembled. In addition, the embossing portions 43*a* of the rubber member 43 are disposed so as to be pressurized rearward. The movable contact 44*b* which is formed on the rear surface side of the embossing portion 43*a* is disposed on the front sides of the fixed contacts 44*a* in the state where the movable contact 44*b* can come into contact with and can be separated from the fixed contacts 44*a* which are formed on the front surface side of the wiring substrate 42. Moreover, the light-emitting elements 45 which are mounted on the front surface of the wiring substrate 42 are accommodated in the element accommodating portion 43*b* of the rubber member 43. In addition, the light which is emitted from the light-emitting elements 45 transmit the rubber member 43, and is radiated forward through the pressing opening portion 41*e* of the coil antenna 41.

Next, a method of assembling the engine start switch 1 will be described. First, the operation member 30 is disposed on the front side of the slide member 20 at a predetermined interval. In addition, the antenna substrate assembly 40 is disposed between the slide member 20 and the operation member 30.

Next, positioning among the slide member 20, the operation member 30, and the antenna substrate assembly 40 is performed so that the antenna substrate assembly 40 is positioned in a space which is surrounded by the slide member 20, the operation member 30, and the connection portion 50. In addition, the attaching portions 60 protrude to the rear side of the slide member 20 via the attaching notch portions 23 of the slide member 20. The connecting convex portions 22 of the slide member 20 are fitted to the connecting hole portions 51 of the connection portion 50, and thus, the slide member 20 and the operation member 30 are connected to each other. As a result, the slide member 20 and the operation member 30 can relatively move in the front-rear direction with respect to the antenna substrate assembly 40.

In addition, since the antenna substrate assembly 40 is positioned in the space which is surrounded by the slide member 20, the operation member 30, and the connection member 50, even when the connection portion 50 moves in the front-rear direction along with the operation member 30 or the slide member 20, the connection portion 50 does not abut the antenna substrate assembly 40, and the relative movements of the slide member 20 and the operation member 30 with respect to the antenna substrate assembly 40 in the front-rear direction are not disturbed.

Moreover, the attaching notch portions 23 are formed at the positions of the slide member 20 corresponding to the attaching portions 60. The attaching portions 60 protrude to the rear side of the slide member 20 via the attaching notch portions 23 of the slide member 20. Accordingly, even when the slide member 20 and the operation member 30 move in the front-rear direction, the attaching portions 60 do not abut the slide member 20, and the relative movements of the slide member 20 and the operation member 30 with respect to the antenna substrate assembly 40 in the front-rear direction are not disturbed.

Next, the slide member 20, the operation member 30, and the antenna substrate assembly 40 are inserted into the opening portion 11*a* of the case member 10, and the rear end portions 61 of the attaching portions 60 engage with the attaching holes (not shown) of the case member 10. Therefore, the antenna substrate assembly 40 is attached to the case member 10. In addition, the slide member 20 and the operation member 30 can relatively move in the front-rear direction with respect to the case member 10.

Moreover, as described above, the connector 46 which includes the external connection terminals 46*a* extending rearward is attached at the position close to the lower side on the rear surface side of the wiring substrate 42, and the main body portion of the connector 46 is accommodated in the space which is formed by the connector notch portion 24 of the slide member 20. In addition, the external connection terminals 46*a* protrude rearward via through-holes formed on the front surface side of the terminal accommodating portion 14 of the case member 10, and the tip portions of the external connection terminals 46*a* are accommodated in the inner portion of the terminal accommodating portion 14. Moreover, the external connection terminals 46*a* are connected to the external circuit via external wires (not shown).

Figure 6A:
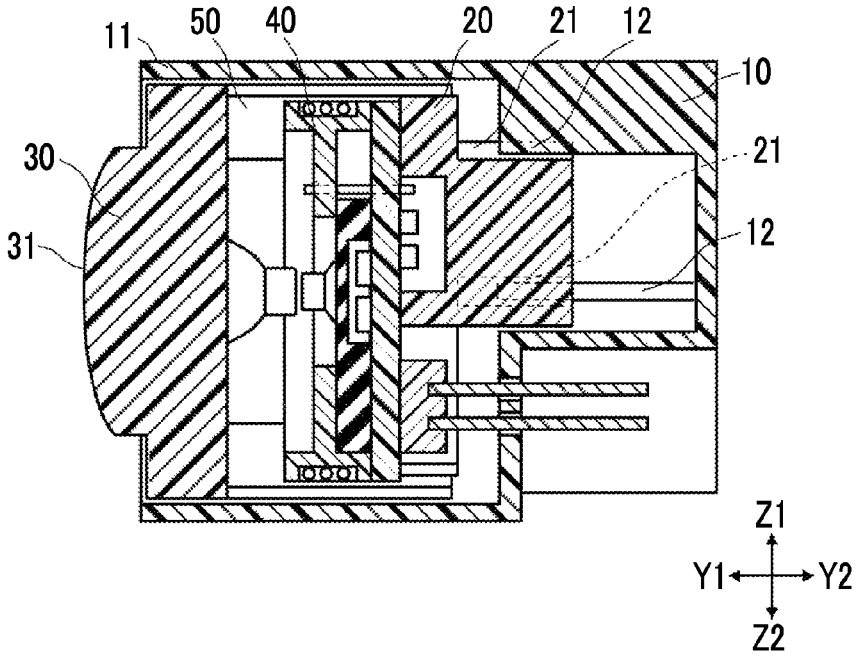
FIGS. 6A and 6B are first schematic views showing the operation of the engine start switch 1 shown in FIG. 1.
Figure 6B:
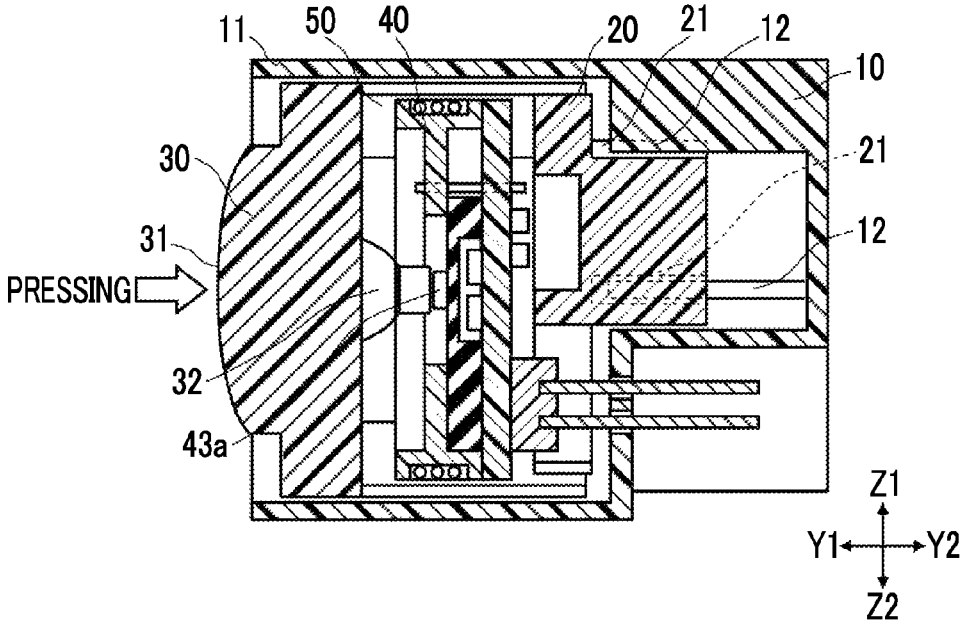
Figure 7A:
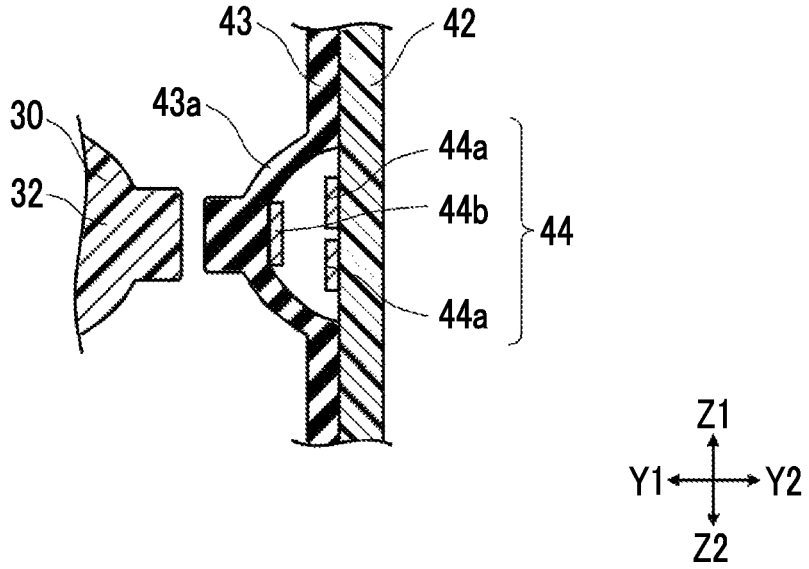
FIGS. 7A and 7B are second schematic views showing the operation of the engine start switch 1 shown in FIG. 1.
Figure 7B:
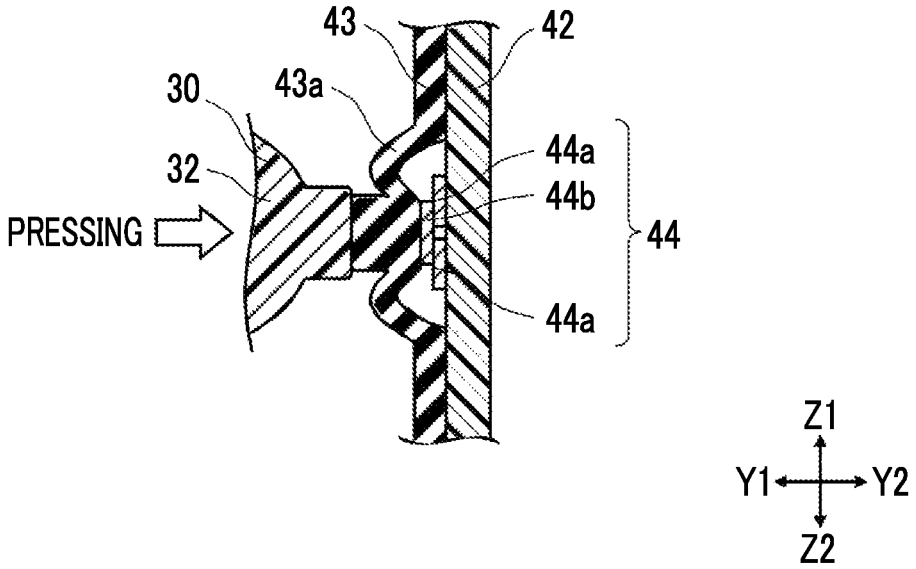

Next, an operation of the engine start switch 1 will be described. First, an operation corresponding to a pressing operation with respect to the engine start switch 1 will be described with reference to FIGS. 6A to 7B. FIGS. 6A and 6B are first schematic views showing the operation of the engine start switch 1 shown in FIG. 1. FIG. 6A shows the state of the engine start switch 1 before the pressing operation, and FIG. 6B shows the state of the engine start switch 1 during the pressing operation. FIGS. 7A and 7B are second schematic views showing the operation of the engine start switch 1 shown in FIG. 1. FIG. 7A shows the state of the switch element 44 before the pressing operation, and FIG. 7B shows the state of the switch element 44 during the pressing operation.

As shown in FIGS. 6A to 7B, when the operation surface 31 of the operation member 30 is pressed rearward, the slide member 20 and the operation member 30 move rearward. Meanwhile, even when the operation surface 31 of the operation member 30 is pressed, the antenna substrate assembly 40 attached to the case member 10 does not move. As a result, the pressing portion 32 of the operation member 30 presses the embossing portion 43*a* of the antenna substrate assembly 40, and the embossing portion 43*a* is elastically deformed rearward. According to the rearward deformation of the embossing portion 43*a*, the movable contact 44*b* of the embossing portion 43*a* side comes into contact with the fixed contacts 44*a* of the wiring substrate 42 side.

If the pressing with respect to the operation surface 31 is released, the slide member 20 and the operation member 30 move forward by a repellent force of the rubber member 43. In addition, the embossing portion 43*a* is returned to an original state from the elastically deformed state, and thus, the movable contact 44*b* is separated from the fixed contacts 44*a*. The switch element 44 detects the rearward movement of the operation member 30 using the contact and the separation between the fixed contacts 44*a* and the movable contact 44*b* corresponding to the pressing operation with respect to the operation surface 31 of the operation member 30.

In addition, when authentication between the on-board communication device and the electronic key in the keyless entry system is established, if the operation surface 31 of the engine start switch 1 is press-operated, electric signals corresponding to the pressing operation are transmitted to the on-board control device (not shown) from the engine start switch 1, and an engine can be started or stopped. In addition, in the present embodiment, when at least one of the above-described two switch elements 44 detects the rearward movement of the operation member 30, the electric signals corresponding to the pressing operation are transmitted to the on-board control device.

Figure 8A:
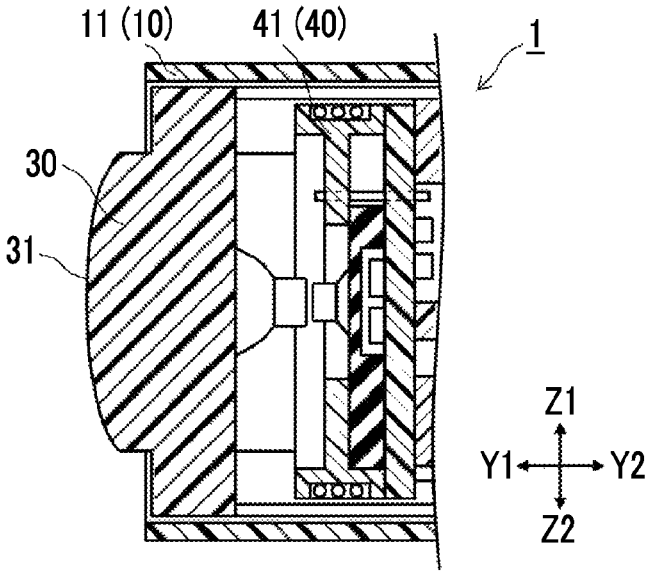
FIGS. 8A and 8B are third schematic views showing the operation of the engine start switch 1 shown in FIG. 1.
Figure 8B:
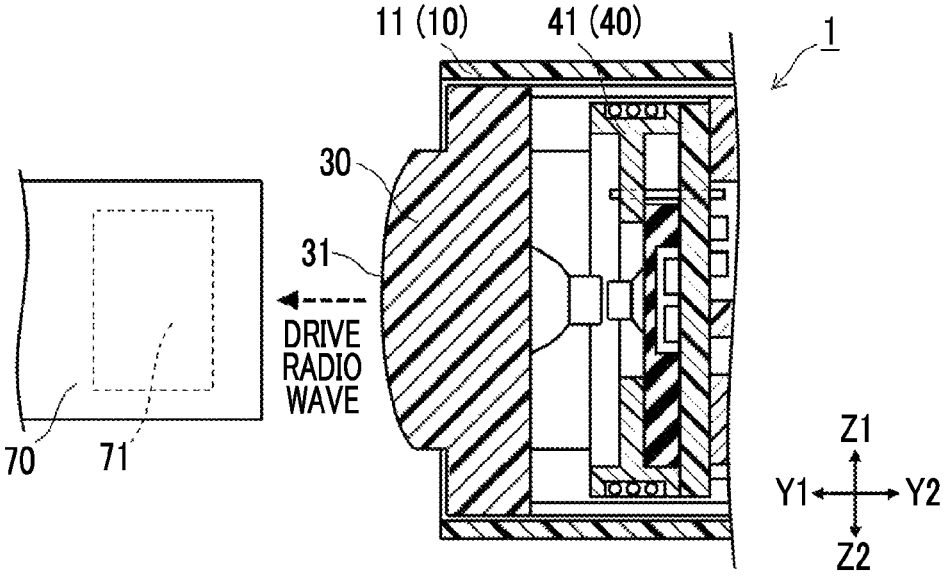
Figure 9:
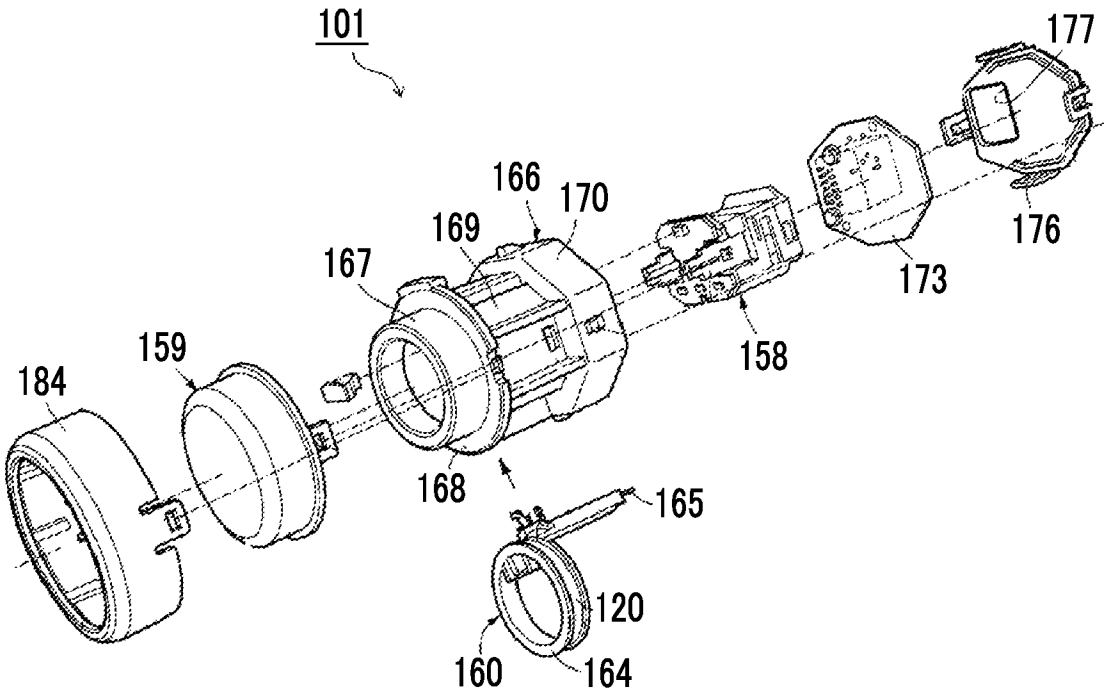
FIG. 9 is an exploded perspective view showing a start and stop switch Device 101 according to U.S. Pat. No. 8,810,363.

Next, an operation when the electronic key 70 approaches the engine start switch 1 will be described with reference to FIGS. 8A and 8B. FIGS. 8A and 8B are third schematic views showing the operation of the engine start switch 1 shown in FIG. 1. FIG. 8A shows a case where the electronic key 70 does not approach the engine start switch 1, and FIG. 8B shows a case where the electronic key 70 approaches the engine start switch 1.

As shown in FIGS. 8A and 8B, when the electronic key 70 approaches the engine start switch 1 and the electronic key 70 is held before the operation surface 31 of the engine start switch 1, the engine start switch 1 detects approaching of the electronic key 70 and radiates (outputs) power-transmission electromagnetic wave signals (hereinafter, abbreviated as drive radio waves) forward from the coil antenna 41 of the antenna substrate assembly 40.

The electronic key 70 includes a power receiving circuit 71, and the power receiving circuit 71 receives the drive radio waves radiated from the coil antenna 41, rectifies the electric signals obtained by receiving the drive radio waves, and converts the electric signals into power for driving a communication circuit (not shown) of the electronic key 70 side. In the present embodiment, in this way, even when a battery of the electronic key 70 side is consumed and response signals are not sent from the electronic key 70, it is possible to perform the operation with respect to the keyless entry system.

In addition, since a configuration of the power receiving circuit 71 of the electronic key 70, a method for converting the drive radio waves received by the electronic key 70 into power, a method for detecting the approaching of the electronic key 70 by the engine start switch 1, or the like is well-known, detailed descriptions thereof are omitted.

Next, effects of the present invention will be described. In the engine start switch 1 of the present embodiment, since the coil antenna 41 is attached to the front side of the wiring substrate 42 to configure the antenna substrate assembly 40, it is possible to handle the coil antenna 41 and the wiring substrate 42 as an integral member when the engine start switch 1 is assembled. In addition, since it is possible to dispose the coil antenna 41 in the vicinity of the wiring substrate 42, a wiring member for connecting the circuit connection terminal 41*c* of the coil antenna 41 and the wiring substrate 42 is not needed. As a result, it is possible to decrease the number of components when the engine start switch 1 is assembled. In addition, since the number of components is decreased, it is possible to simply assemble the engine start switch 1.

Moreover, in the engine start switch 1 of the present embodiment, the connection portion 50 connects the slide member 20 and the operation member 30 so that relative movements of the slide member 20 and the operation member 30 with respect to the antenna substrate assembly 40 in the front-rear direction are not disturbed. Accordingly, even when the antenna substrate assembly 40 is disposed between the slide member 20 and the operation member 30, it is possible to smoothly move the slide member 20 and the operation member 30.

In addition, in the engine start switch 1 of the present embodiment, the antenna substrate assembly 40 is disposed in the space surrounded by the slide member 20, the operation member 30, and the connection portion 50. Accordingly, even when the connection portion 50 moves in the front-rear direction along with the operation member 30 or the slide member 20, it is possible to prevent the connection portion 50 from being abutted to the antenna substrate assembly 40. As a result, it is possible to more smoothly move the slide member 20 and the operation member 30.

Moreover, in the engine start switch 1 of the present embodiment, the attaching portion 60 attaches the antenna substrate assembly 40 to the case member 10 so that the relative movements of the slide member 20 and the operation member 30 with respect to the antenna substrate assembly 40 in the front-rear direction are not disturbed. Accordingly, even when the antenna substrate assembly 40 is disposed between the slide member 20 and the operation member 30, it is possible to smoothly move the slide member 20 and the operation member 30.

In addition, in this engine start switch 1 of the present embodiment, the attaching portion 60 extends rearward from the outer circumferential portion of the bobbin portion 41*a* of the coil antenna 41, and the attaching notch portion 23 is formed at a position corresponding to the attaching portion 60 of the slide member 20. Accordingly, even when the slide member 20 and the operation member 30 move in the front-rear direction, it is possible to prevent the attaching portion 60 from being abutted to the slide member 20. As a result, it is possible to more smoothly move the slide member 20 and the operation member 30.

In addition, in this engine start switch 1, the detection means for detecting the rearward movement of the operation member 30 is the switch element 44 configured to include the fixed contact 44*a* which is formed on the front surface side of the wiring substrate 42, and the movable contact 44*b* which is disposed on the front side of the fixed contact 44*a*. The structure of the switch element 44 having the above-described configuration is simple. Accordingly, it is possible to further decrease the number of components of the engine start switch 1. Moreover, since the switch element 44 having the above-described configuration is easily thinned, it is possible to shorten the length of the engine start switch 1 in the front-rear direction.

Moreover, in the engine start switch 1 of the present embodiment, since the light-emitting element 45 is mounted on the front surface side of the wiring substrate 42, it is possible to illuminate the operation member 30. In addition, since the operation member 30 is disposed on the front side of the wiring substrate 42, it is possible to shorten the distance between the operation member 30 and the light-emitting element 45, and it is possible to increase illumination efficiency.

Moreover, in the engine start switch 1 of the present embodiment, since the terminal accommodating portion 14 serving as the concave portion, in which the external connection terminal 46*a* is accommodated, is formed at the position of the case member 10 corresponding to the connector 46, the external connection terminal 46*a* of the connector 46 and the external wire can be connected to each other inside the terminal accommodating portion 14. Accordingly, compared to a case where the external connection terminal 46*a* of the connector 46 and the external wire are connected to each other on the rear side of the case member 10, it is possible to shorten the length of the engine start switch 1 in the front-rear direction. In addition, since the connector 46 is disposed at the position (the position close to the lower side) close to the outer circumferential portion of the rear surface side of the wiring substrate 42, it is possible to open the outer circumferential portion side (the lower side) of the terminal accommodating portion 14, and a connection work between the external connection terminal 46*a* of the connector 46 and the external wire is easily performed.

Hereinbefore, the embodiment of the present invention is described. However, the present invention is not limited to the above-described embodiment, and can be appropriately changed within a scope which does not depart from the object of the present invention.

For example, in the embodiment of the present invention, the detection means for detecting the rearward movement of the operation member 30 may be elements other than the above-described switch element. For example, the detection means may be a slide switch which includes a fixed contact and a sliding contact which slides in the front-rear direction. In addition, the detection means may detect the rearward movement of the operation member using magnetism, electrostatic capacity, infrared light, electromagnetic waves, or the like.

Moreover, in the embodiment of the present invention, the number of the switch elements 44 may be a number other than two. For example, if it is possible to reliably detect the movement of the operation member 30, one switch element 44 may be adopted. In addition, a complicated operation corresponding to the pressing operation may be performed using three or more switch elements 44.

In addition, in the embodiment of the present invention, the number of light-emitting elements 45 may be a number other than two. For example, if it is possible to obtain a sufficient illumination function, one light-emitting element 45 may be adopted. In addition, more complicated illumination may be performed using three or more light-emitting elements 45. In this case, a color or intensity of light for each light-emitting element 45 may be changed.

In addition, in the embodiment of the present invention, the connection portion 50 may adopt structures other than the above-describe structure. For example, after the connection portion 50 is formed to be separated from the operation member 30, the slide member 20 and the operation member 30 may be connected to each other via the connection portion 50. In addition, after the connection portion 50 is integrally formed with the slide member 20, the connection portion 50 may be connected to a predetermined location of the operation member 30.

In addition, the attaching portion 60 may adopt structures other than the above-describe structure. For example, after the attaching portion 60 is formed to be separated from the coil antenna 41, the coil antenna 41 may be attached to the case member 10 via the attaching portion 60. In addition, after the attaching portion 60 is integrally formed with the case member 10, the attaching portion 60 may engage with a predetermined location of the coil antenna 41.

Moreover, in the embodiment of the present invention, instead of the attaching notch portion 23 or the connector notch portion 24, a circular opening portion or a rectangular opening portion formed on the slide member may be used.

It should be understood by those skilled in the art that various modifications, combinations, sub-combinations and alterations may occur depending on design requirements and other factors insofar as they are within the scope of the appended claims of the equivalents thereof.

What is claimed is:

1. An engine starting switch, comprising:

a case member including a tubular support portion having an opening formed on a front side thereof;

a sliding member slidably supported inside the tubular support portion, the sliding member being slidable in a front-rear direction;

an operation member coupled to a front side of the sliding member and movably supported in a front portion of the tubular support portion, the operation member being movable in the front-rear direction;

a detection unit configured to detect a rearward movement of the operation member;

an antenna-substrate assembly attached to the case member and disposed between the sliding member and the operation member, the antenna-substrate assembly including:

a wiring substrate; and an annular coil antenna attached to a front side of the wiring substrate and electrically connected thereto, the coil antenna being configured to radiate a radio wave signal in a forward direction; and an attaching portion configured to attach the antenna substrate assembly to the case member such that relative movements of the sliding member and the operation member in the front-rear direction with respect to the antenna substrate assembly are not obstructed, wherein the coil antenna includes an annular bobbin portion for winding a wire formed in a coil, wherein the attaching portion extends rearward from an outer circumferential portion of the bobbin portion, and wherein the sliding member includes a notch portion or an opening portion formed at a position corresponding to the attaching portion so as to receive the attaching portion.

2. The engine starting switch according to claim 1, further comprising:

a connection portion coupling the operation member to the slide member such that relative movements of the slide member and the operation member in the front-rear direction with respect to the antenna substrate assembly are not obstructed.

3. The engine starting switch according to claim 2, wherein the operation member is disposed in front of the sliding member with a predetermined gap therebetween, and wherein the connection portion extends rearward from an outer circumferential portion of the operation member so as to surround a space between the operation member and the sliding member, the antenna substrate assembly being disposed in the space.

4. The engine starting switch according to claim 1, wherein the detection unit is a switch element including:

a fixed contact formed on a front surface side of the wiring substrate, and a movable contact disposed on a front side of the fixed contact, the movable contact coming into contact with and becoming separated from the fixed contact in conjunction with a pressing operation of the operation member.

* * * * *